US005369354A

United States Patent [19]

Mori

[11] Patent Number: 5,369,354

[45] Date of Patent: Nov. 29, 1994

[54] INTERMEDIATE VOLTAGE GENERATING CIRCUIT HAVING LOW OUTPUT IMPEDANCE

[75] Inventor: Shigeru Mori, Hyogo, Japan

[73] Assignee: Mitsubishi Denki Kabushiki Kaisha, Tokyo, Japan

[21] Appl. No.: 107,882

[22] Filed: Aug. 18, 1993

[30] Foreign Application Priority Data

Oct. 14, 1992 [JP] Japan ..... 4-275802

[51] Int. Cl.[5] ..... G05F 3/16; G05F 3/20

[52] U.S. Cl. ..... 323/313

[58] Field of Search ..... 323/312, 313, 314, 315; 307/296.6, 296.1, 296.7, 296.8

[56] References Cited

U.S. PATENT DOCUMENTS 4,442,398 4/1984 Bertails et al. ..... 323/315
4,788,455 11/1988 Mori et al. ..... 323/314 X
5,008,609 4/1991 Fukiage ..... 323/315

OTHER PUBLICATIONS

"An Experimental 1.5-V 64-Mb DRAM", by Yoshinobu Nakagome, IEEE Journal of Solid-State Circuits, vol. 26, No. 4, Apr. 1991, pp. 465-472.

*Primary Examiner*—Steven L. Stephan
*Assistant Examiner*—E. To
*Attorney, Agent, or Firm*—Lowe, Price, LeBlanc & Becker

[57] ABSTRACT

By reducing output impedance of an intermediate voltage generating circuit used in a DRAM and the like, an output voltage quickly recovers to an intermediate voltage even in the case where the output voltage fluctuates heavily. The intermediate voltage generating circuit includes a first reference voltage generating circuit, a second reference voltage generating circuit, a first intermediate voltage output stage, and a second intermediate voltage output stage. An MOS transistor configuring a current mirror is provided with the first and second intermediate voltage output stages. The size of the MOS transistor of the second intermediate voltage output stage is larger than that of a transistor of the first intermediate voltage output stage. As a result, in response to a current flowing in either transistor of the first intermediate voltage output stage, a current having a value equal to or more than that of the current flowing in either transistor of the first intermediate voltage output stage is supplied to an output node, whereby the output impedance is reduced.

8 Claims, 5 Drawing Sheets

INTERMEDIATE VOLTAGE GENERATING CIRCUIT HAVING LOW OUTPUT IMPEDANCE

BACKGROUND OF THE INVENTION

1. Field of the Invention

The present invention relates to intermediate voltage generating circuits having low output impedance, and more particularly, to an intermediate voltage generating circuit for generating, based on externally supplied first and second voltages, an intermediate voltage of a level between the voltages at a predetermined output node.

2. Description of the Background Art

In a DRAM (Dynamic Random Access Memory) which is a semiconductor integrated circuit device, an intermediate voltage generating circuit is included for generating a voltage lower than an external power supply voltage $V_{cc}$, for example, a voltage $(\frac{1}{2}).V_{cc}$, which is half the external power supply voltage $V_{cc}$, in order to supply a bit line precharge voltage, a cell plate voltage and the like.

FIG. 6 is a schematic diagram of a circuit showing one example of an intermediate voltage generating circuit shown in U.S. Pat. No. 4,788,455.

Referring to FIG. 6, the intermediate voltage generating circuit includes a first reference voltage generating circuit 1 for generating a first reference voltage, a second reference voltage generating circuit 2 for generating a second reference voltage, and an intermediate voltage output stage 3 for providing an intermediate voltage $(\frac{1}{2}).V_{cc}$ upon receiving these reference voltages.

First reference voltage generating circuit 1 includes resistors R1 and R2, and diode-connected N channel MOS transistors Q1 and Q2. Resistors R1, R2 and transistors Q1, Q2 are connected in series between the power supply voltage $V_{cc}$ and the ground GND.

Second reference voltage generating circuit 2 includes resistors R3 and R4, and diode-connected P channel MOS transistors Q3 and Q4. Resistors R3, R4 and transistors Q3, Q4 are connected in series between the power supply voltage $V_{cc}$ and the ground GND.

Intermediate voltage output stage 3 includes an N channel MOS transistor Q5 receiving at its gate the first reference voltage generated at a node NO1 of first reference voltage generating circuit 1, and a P channel MOS transistor Q6 receiving at its gate the second reference voltage generated at a node NO4 of second reference voltage generating circuit 2. Transistors Q5, Q6 are connected in series between the power supply voltage $V_{cc}$ and the ground GND.

Operations of the intermediate voltage generating circuit will now be described.

In first reference voltage generating circuit 1, when resistance values of resistors R1 and R2 are made equal to each other and characteristics of transistors Q1 and Q2 are made equal to each other, the voltage $(\frac{1}{2}).V_{cc}$ which is half the external power supply voltage $V_{cc}$ is generated at a node NO2. Therefore, a voltage $(\frac{1}{2}).V_{cc}+V_{THN}$ is generated at node NO1 which is higher than the voltage $(\frac{1}{2}).V_{cc}$ of node NO2 by a threshold voltage $V_{THN}(>0)$ of N channel MOS transistor Q1.

On the other hand, in second reference voltage generating circuit 2, when resistance values of resistors R3 and R4 are made equal to each other, and characteristics of transistors Q3 and Q4 are made equal to each other, the voltage $(\frac{1}{2}).V_{cc}$ which is half the power supply voltage $V_{cc}$ is generated at a node NO3, similar to the above. Therefore, a voltage $(\frac{1}{2}).V_{cc}-|V_{THP}|$ is generated at a node NO4 which is lower than the voltage $(\frac{1}{2}).V_{cc}$ of node NO3 by an absolute value $|V_{THP}|$ of a threshold voltage $V_{THP}(<0)$ of P channel MOS transistor Q4.

Resistance values of resistors R1, R2, R3 and R4 are set so large that only a little current flows in first and second reference voltage generating circuits 1 and 2.

In intermediate voltage output stage 3, the first reference voltage $(\frac{1}{2}).V_{cc}+V_{THN}$ is applied to the gate of N channel MOS transistor Q5, so that, when an output voltage $V_{OUT}$ is lower than the intermediate voltage $(\frac{1}{2}).V_{cc}$, N channel MOS transistor Q5 is turned on, whereby the output voltage $V_{OUT}$ is pulled up to attain the intermediate voltage $(\frac{1}{2}).V_{cc}$. On the other hand, the second reference voltage $(\frac{1}{2}).V_{cc}-|V_{THP}|$ is applied to the gate of P channel MOS transistor Q6, so that, when the output voltage $V_{OUT}$ is higher than the intermediate voltage $(\frac{1}{2}).V_{cc}$, P channel MOS transistor Q6 is turned on, whereby the output voltage $V_{OUT}$ is pulled down to attain the intermediate voltage $(\frac{1}{2}).V_{cc}$.

More specifically, when the output voltage $V_{OUT}$ is higher or lower than the intermediate voltage $(\frac{1}{2}).V_{cc}$, the output voltage $V_{OUT}$ is pulled up or down to the intermediate voltage $(\frac{1}{2}).V_{cc}$ to finally reach the same.

In a steady state where the output voltage $V_{OUT}$ attains the intermediate voltage $(\frac{1}{2}).V_{cc}$, both N channel MOS transistor Q5 and P channel MOS transistor Q6 are slightly turned off. More specifically, these transistors Q5 and Q6 are not completely but slightly in an off state. Therefore, little current flows in intermediate voltage output stage 3.

As described above, in a conventional intermediate voltage generating circuit, when the output voltage $V_{OUT}$ is lower or higher than the intermediate voltage $(\frac{1}{2}).V_{cc}$, transistor Q5 or Q6 of intermediate voltage output stage 3 is turned on, causing the output voltage $V_{OUT}$ to be pulled up or pulled down to $(\frac{1}{2}).V_{cc}$. In such a non-steady state, both transistors Q5 and Q6 are only slightly turned on. Therefore, when the voltage at an input node of a circuit to which the output voltage $V_{OUT}$ is applied fluctuates heavily, intermediate voltage output stage 3 does not supply sufficient current, making it impossible to maintain the output voltage $V_{OUT}$ at the intermediate voltage $(\frac{1}{2}).V_{cc}$. In other words, there was a problem that the output impedance of the conventional intermediate voltage generating circuit is high.

As one example of the conventional intermediate voltage generating circuit having an improved response speed of a transistor in an intermediate voltage output stage, an intermediate voltage generating circuit as shown in FIG. 7 has been disclosed in *IEEE Journal of Solid-State Circuits*, Vol. 26, No. 4, April, 1991.

The intermediate voltage generating circuit is likely to operate as follows. In the description hereinafter, the external power supply $V_{cc}$ is 5 V, and the threshold voltage $V_{THN}$ and $|V_{THP}|$ of N channel and P channel MOS transistors is 1 V.

FIG. 8 is a graph showing how the output voltage $V_{OUT}$ and voltages of nodes NO5 and NO6 of MOS transistors M11 and M3, respectively, both configuring a push-pull output stage 4, change in accordance with the lapse of time.

Referring to FIG. 8, when the output voltage $V_{OUT}$ is lower than $(\frac{1}{2}).V_{cc}$ (2.5 V) ($t_0$ to $t_1$), an N channel MOS transistor M8 configuring a push-pull current mirror amplifier 5 is turned on, causing a current flow $\Delta i$ to be produced in transistor M8. As a result, a current mirror configured of P channel MOS transistors M9 and M10 operates so that a current flow i is produced in transistor M10. Since P channel and N channel MOS transistors M1 and M12 configuring push-pull current mirror amplifier 5 is turned off at this time, N channel MOS transistor M2 is also turned off which configures a current mirror together with transistor M12. Therefore, the current flow i is entirely used for charging the gate electrode of an N channel MOS transistor M11 because there is no path to the ground.

As a result, N channel MOS transistor M11 is turned on ($t_1$), causing the output voltage $V_{OUT}$ to be pulled up. In order to make it possible for N channel MOS transistor M11 to be sufficiently turned on, the voltage of a gate node NO5 of transistor M11 must be pulled up to a voltage sufficiently higher than $(\frac{1}{2}).V_{cc}$.

As a result, even at a timing ($t_2$) when the output voltage $V_{OUT}$ attains the intermediate voltage $(\frac{1}{2}).V_{cc}$, a high voltage is still maintained at node NO5. Therefore, N channel MOS transistor M11 is maintained in an on state for a while ($t_2$ to $t_3$).

On the other hand, when the output voltage $V_{OUT}$ exceeds the intermediate voltage $(\frac{1}{2}).V_{cc}$ ($t_2$), another P channel MOS transistor M1 and N channel MOS transistor M12 configuring push-pull current amplifier 5 are turned on, whereby N channel MOS transistor M2 configuring a current mirror together with transistor M12 is turned on. As a result, a current path is formed for discharge from node NO5. When the voltage of node NO5 is decreased to the voltage higher than the output voltage $V_{OUT}$ by the threshold voltage $V_{THN}$ of transistor M11, transistor M11 is turned off.

Ideally, a voltage $V_{THN}+|V_{THP}|$ which is the sum of the threshold voltage $V_{THN}$ of the N channel MOS transistor and the absolute value $|V_{THP}|$ of the threshold voltage of the P channel MOS transistor is always maintained between node NO5 and node NO6. Therefore, when N channel MOS transistor M11 is turned off ($t_3$), P channel MOS transistor M3 is turned on.

As described above, the output voltage $V_{OUT}$ converges to the intermediate voltage $(\frac{1}{2}).V_{cc}$ at timings $t_2$, $t_4$, $t_6$ and $t_8$ after it crosses over the boundary, once at least, of the intermediate voltage $(\frac{1}{2}).V_{cc}$.

Accordingly, it is considered that the intermediate voltage generating circuit has at least three problems as in the following.

A first problem is occurrence of overshoot or undershoot. Transistors M11 and M3 configuring push-pull output stage 4 are controlled by supply of charge to the gate electrodes. Therefore, even at a timing when transistor M11 or M3 may not be turned on, the charge stored at the gate electrodes is not immediately discharged, whereby overshoot or undershoot never fails to occur.

A second problem is occurrence of oscillation. Since the intermediate voltage generating circuit easily oscillates, it is necessary to appropriately specify the size of each transistor to prevent the same from oscillating.

A third problem is high output impedance. In the intermediate voltage generating circuit, since transistors M11 and M3 configuring push-pull output stage 4 are only slightly turned on in a non-steady state, the output impedance is high.

SUMMARY OF THE INVENTION

One object of the present invention is to reduce output impedance of an intermediate voltage generating circuit.

Another object of the present invention is to maintain the output voltage at the intermediate voltage $(\frac{1}{2}).V_{cc}$ as much as possible by supplying sufficient current outside, even when the output voltage of the intermediate voltage generating circuit fluctuates heavily.

Still another object of the present invention is to rapidly recover the output voltage to the intermediate voltage when the output voltage of the intermediate voltage generating circuit is shifted from the intermediate voltage.

A further object of the present invention is to consume as little current as possible in a steady state where the output voltage of the intermediate voltage generating circuit is maintained at the intermediate voltage.

The present invention includes an intermediate voltage generating circuit for generating an intermediate voltage between externally supplied first and second voltages. In brief, the present invention includes an output node, an intermediate voltage output circuit, a first reference voltage generating circuit, a second reference voltage generating circuit, and at least one current mirror circuit.

The intermediate voltage output circuit includes a first N channel MOS transistor and a first P channel MOS transistor connected in series between the first and second voltages and having sources connected to the output node.

The first reference voltage generating circuit generates a first reference voltage shifted from the intermediate voltage by a threshold voltage of the first N channel MOS transistor substantially to provide the first reference voltage to a gate of the first N channel MOS transistor.

The second reference voltage generating circuit generates a second reference voltage shifted from the intermediate voltage by a threshold voltage of the first P channel MOS transistor substantially to provide the second reference voltage to a gate of the first P channel MOS transistor.

The current mirror circuit is responsive to a current flowing in either of the first N channel or P channel MOS transistor for supplying a current having a value equal to or more than a value of the current flowing in either of the first N channel or P channel MOS transistor to the output node.

According to another aspect of the present invention, the intermediate voltage generating circuit includes an output node, a first intermediate voltage output circuit, a second intermediate voltage output circuit, a first reference voltage generating circuit, and a second reference voltage generating circuit.

The first intermediate voltage output circuit includes a first N channel MOS transistor, a first P channel MOS transistor, a second P channel MOS transistor, and a second N channel MOS transistor.

The first N channel MOS transistor and the first P channel MOS transistor are connected in series between the first and the second voltages, and have sources connected to the output node.

The second P channel MOS transistor is connected between the first voltage and the first N channel MCS transistor, and has a gate and a drain connected to each other.

The second N channel MOS transistor is connected between the first P channel MOS transistor and the second voltage, and has a gate and a drain connected to each other.

The second intermediate voltage output circuit includes a third P channel MOS transistor, and a third N channel MOS transistor.

The third P channel MOS transistor and the third N channel MOS transistor are connected in series between the first and the second voltages, and have sources connected to gates and drains of the second P channel and N channel MOS transistors, and drains connected to the output node.

The main advantage of the present invention is that the voltage of the output node can be quickly pulled up or down to the intermediate voltage even when the voltage of the output node fluctuates heavily, because of provision of the current mirror or first and second intermediate voltage output stages.

In addition, the present invention provides the following advantage. The threshold voltage of the first N channel MOS transistor is larger than the threshold voltage of the N channel MOS transistor used as a reference for generating the first reference voltage, and the absolute value of the threshold voltage of the first P channel MOS transistor is larger than the absolute value of the threshold voltage of the P channel MOS transistor used as a reference for generating the second reference voltage. Therefore, even when the voltage between the first and second voltages fluctuates in a steady state where the voltage of the output node is the intermediate voltage, transistors configuring an intermediate voltage output circuit and a current mirror, or first and second intermediate voltage output stages are not turned on, whereby through current does not flow in these transistors.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
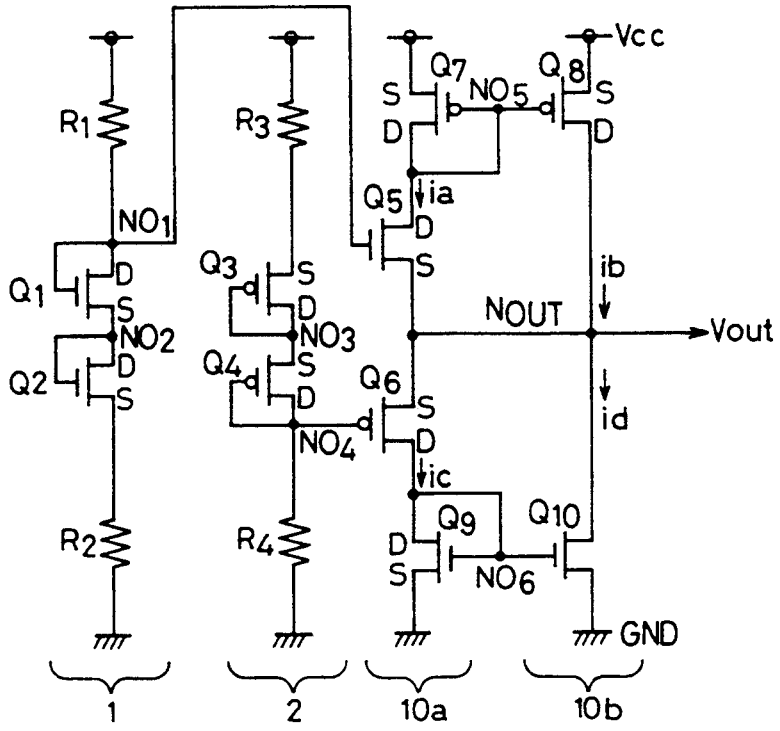
FIG. 1 is a schematic diagram showing an intermediate voltage generating circuit of a first embodiment in accordance with the present invention.

FIG. 1 is a schematic diagram showing an intermediate voltage generating circuit of the first embodiment in accordance with the present invention. Referring to FIG. 1, the intermediate voltage generating circuit includes reference voltage generating circuit 1, a second reference voltage generating circuit 2, a first intermediate voltage output stage 10*a*, and a second intermediate voltage output stage 10*b*.

First reference voltage generating circuit 1 includes two N channel MOS transistors Q1 and Q2, and resistors and R2. These transistors Q1, Q2 and resistors R1, R2 are connected in series between an external power supply voltage $V_{cc}$ and the ground.

Second reference voltage generating circuit 2 includes two P channel MOS transistors Q3 and Q4, and resistors R3 and R4. These transistors Q3, Q4 and resistors R3, R4 are connected in series between the external power supply voltage $V_{cc}$ and the ground.

First and second reference voltage generating circuits 1 and 2 have the same structure as the first and second reference voltage generating circuits configuring a conventional intermediate voltage generating circuit.

N channel MOS transistors Q1 and Q2 configuring first reference voltage generating circuit 1 have the same characteristics. P channel MOS transistors Q3 and Q4 configuring second reference voltage generating circuit 2 have the same characteristics. On the other hand, resistors R1 and R2 configuring first reference voltage generating circuit 1 have the same resistance value, which is set at a very large value. Resistors R3 and R4 configuring second reference voltage generating circuit 2 has the same resistance value, which is set at a very large value.

First reference voltage generating circuit 1 is means for generating the first reference voltage $(\frac{1}{2}).V_{cc}+V_{THN}$ shifted from the intermediate voltage $(\frac{1}{2}).V_{cc}$ by the threshold voltage $V_{THN}(>0)$ of N channel MOS transistor Q1. Second reference voltage generating circuit 2 is means for generating the second reference voltage $(\frac{1}{2}).V_{cc}+V_{THP}$ shifted from the intermediate voltage $(\frac{1}{2}).V_{cc}$ by the threshold voltage $V_{THP}(<0)$ of P channel MOS transistor Q4.

First intermediate voltage output stage 10*a* includes an N channel MOS transistor Q5 receiving the first reference voltage at its gate, and a P channel MOS transistor Q6 receiving the second reference voltage at its gate. Transistors Q5 and Q6 are connected in series between the power supply voltage $V_{cc}$ and the ground, and the connected portion configures an output node $N_{OUT}$ at which the output voltage $V_{OUT}$ is provided.

First intermediate voltage output stage 10*a* further includes a diode-connected P channel MOS transistor Q7, and a diode-connected N channel MOS transistor Q9. The P channel MOS transistor Q7 is connected in series between the power supply voltage $V_{cc}$ and the N channel MOS transistor Q5, and the N channel MOS transistor Q9 is connected in series between the P channel MOS transistor Q6 and the ground. The diode-connected MOS transistor is a transistor whose gate and source/drain are connected to each other.

Second intermediate voltage output stage 10*b* includes a P channel MOS transistor Q8 having a gate connected to the gate of the P channel MOS transistor Q7, and an N channel MOS transistor Q10 having a gate connected to the gate of the N channel MOS transistor Q9. Transistors Q8 and Q10 are connected in series between the power supply voltage $V_{cc}$ and the ground, and a connected portion configures the output node $N_{OUT}$.

In the first embodiment, a current mirror is configured by combination of the P channel MOS transistor Q7 and the P channel MOS transistor Q8. The current mirror is also configured by combination of the N channel MOS transistor Q9 and the N channel MOS transistor Q10. The external power supply voltage $V_{cc}$ corresponds to the first voltage, and the ground corresponds to the second voltage.

Figure 2:
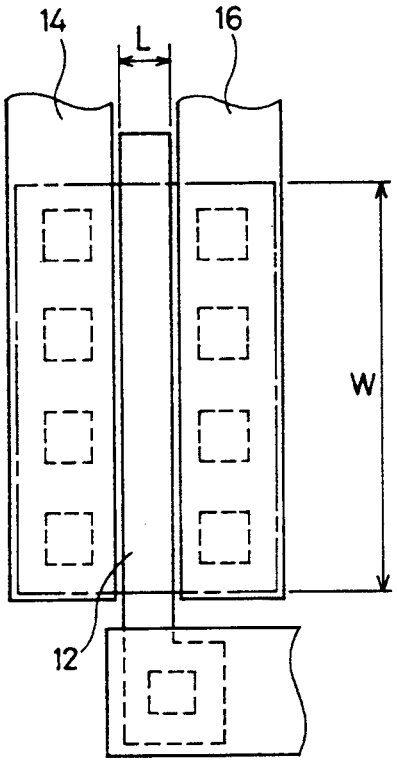
FIG. 2 is a plan view showing a general structure of a transistor.

FIG. 2 is a plan view showing the structure of a general MOS transistor. Referring to FIG. 2, a dot dash line indicates an active region of a transistor, which includes a gate electrode 12, a source electrode 14, and a drain electrode 16. L denotes a channel length, and W denotes a channel width.

Using the channel length L and channel width W, the driving ability D of the transistor is given by the following expression:

$$D \propto W/L$$

In general, transistors are formed on a semiconductor substrate at the same time in one step, so the driving ability of the transistors is set by adjusting the channel length L and/or the channel width W. Usually, the driving ability of the transistor is made large by widening the channel width W while the channel length L is kept constant.

Each channel width of transistors Q8 and Q10 of second intermediate voltage output stage 10b is larger than each channel width of transistors Q7 and Q9 of first intermediate voltage output stage 10a. Therefore, the driving ability of transistors Q8 and Q10 of second intermediate voltage output stage 10b is larger than that of transistors Q7 and Q9 of first intermediate voltage output stage 10a.

For example, when the channel width of transistors Q8 and Q10 of second intermediate voltage output stage 10b is set ten times as large as that of transistors Q7 and Q9 first intermediate voltage output stage 10a, current ib or id flowing in second intermediate voltage output stage 10b is ten times as large as current ia or ic flowing in first intermediate voltage output stage 10a.

Operations of the intermediate voltage generating circuit will now be described.

In first reference voltage generating circuit 1, values of resistors R1 and R2 are equal to each other, and characteristics of N channel MOS transistors Q1 and Q2 are the same. Therefore, the intermediate voltage $(\frac{1}{2}).V_{cc}$ which is half the power supply voltage $V_{cc}$ is generated at node NO2, while the first reference voltage $(\frac{1}{2}).V_{cc}+V_{THN}$ which is the intermediate voltage $(\frac{1}{2}).V_{cc}$ plus the threshold voltage $V_{THN}$ of N channel MOS transistor Q1 is generated at node NO1.

Similarly, in second reference voltage generating circuit 2, values of resistors R3 and R4 are equal to each other, and characteristics of P channel MOS transistors Q3 and Q4 are the same. Therefore, the intermediate voltage $(\frac{1}{2}).V_{cc}$ is generated at node NO3, while the voltage $(\frac{1}{2}).V_{cc}-|V_{THP}|$ which is the intermediate voltage $(\frac{1}{2}).V_{cc}$ minus the absolute value $|V_{THP}|$ of the threshold voltage $V_{THP}$ of P channel MOS transistor Q4 is generated at node NO4.

In a steady state where the. output voltage $V_{OUT}$ is the intermediate voltage $(\frac{1}{2}).V_{cc}$, the first reference voltage $(\frac{1}{2}).V_{cc}+V_{THN}$ is applied to the gate electrode of the N channel MOS transistor Q5, and the intermediate voltage $(\frac{1}{2}).V_{cc}$ is applied to the source electrode of the transistor Q5. Therefore, first N channel MOS transistor Q5 is slightly turned off, causing little current to flow in transistor Q5. The voltage of node NO5 attains a sufficiently high level so that the P channel MOS transistor Q7 is turned off. As a result, the P channel MOS transistor Q8 is also turned off.

On the other hand, the second reference voltage $(\frac{1}{2}).V_{cc}-|V_{THP}|$ is applied to the gate electrode of the P channel MOS transistor Q6, and the intermediate voltage $(\frac{1}{2}).V_{cc}$ is applied to the drain electrode. Therefore, the P channel MOS transistor Q6 is slightly turned off, causing little current to flow in transistor Q6. The voltage of node NO6 also attains a sufficient low level so that the N channel MOS transistor Q9 is turned off. As a result, the N channel MOS transistor Q10 is also turned off.

Accordingly, in such a steady state, a through current flowing in first and second intermediate voltage output stages 10a and 10b is substantially zero.

Description will be given to a non-steady state where the output voltage $V_{OUT}$ is shifted from the intermediate voltage $(\frac{1}{2}).V_{cc}$.

When the output voltage $V_{OUT}$ is lower than the intermediate voltage $(\frac{1}{2}).V_{cc}$, the N channel MOS transistor Q5 is turned on. As a result, the voltage of node NO5 is decreased, causing the P channel MOS transistor Q7 to be turned on. Therefore, first intermediate voltage output stage 10a serves to recover the output voltage $V_{OUT}$ to the intermediate voltage $(\frac{1}{2}).V_{cc}$.

Since the voltage of node NO5 is decreased to the level where the P channel MOS transistor Q7 is turned on at this time, the P channel MOS transistor Q8 is also turned on simultaneously. Therefore, second intermediate voltage output stage 10b also serves to recover the output voltage $V_{OUT}$ to the intermediate voltage $(\frac{1}{2}).V_{cc}$.

More specifically, not only a current ia flowing in the N channel MOS transistor Q5 of first intermediate voltage output stage 10a, but also a current ib flowing in the P channel MOS transistor Q8 of second intermediate voltage output stage 10b flow outside through the output node No. As a result, the output impedance of the intermediate voltage generating circuit is decreased. Therefore, even when the precharge voltage of, for example, a bit line to which the output voltage $V_{OUT}$ is applied fluctuates heavily, the output voltage $V_{OUT}$ is quickly recovered to the intermediate voltage $(\frac{1}{2}).V_{cc}$.

For example, when the gate width of the P channel MOS transistor Q8 is set ten times as large as that of the P channel MOS transistor Q7, the current ib flowing in the P channel MOS transistor Q8 becomes ten times as large as the current ia flowing in the N channel MOS transistor Q5. Therefore, the output impedance of the intermediate voltage generating circuit becomes one eleventh as large as that of the conventional intermediate voltage generating circuit.

On the other hand, when the output voltage $V_{OUT}$ exceeds the intermediate voltage $(\frac{1}{2}).V_{cc}$, the P channel MOS transistor Q6 is turned on. As a result, the voltage of node NO6 is increased, causing the N channel MOS transistor Q9 to be turned on. Therefore, first intermediate voltage output stage 10a serves to recover the output voltage $V_{OUT}$ to the intermediate voltage $(\frac{1}{2}).V_{cc}$. At this time, since the voltage of node NO6 is increased to the extent that the N channel MOS transistor Q9 is turned on, the N channel MOS transistor Q10 is turned on simultaneously. Second intermediate voltage output stage 10b also serves to recover the output voltage $V_{OUT}$ to the intermediate voltage $(\frac{1}{2}).V_{cc}$.

A ratio of the current ic externally flowing into the P channel MOS transistor Q6 of first intermediate voltage output stage 10a through the node $N_{OUT}$ to the current id externally flowing into the N channel MOS transistor Q10 of second intermediate voltage output stage 10b through the node $N_{OUT}$ is equal to a ratio of the size of transistor Q9 of first intermediate voltage output stage 10a to that of transistor Q10 of second intermediate voltage output stage 10b, similar to the case where the output voltage $V_{OUT}$ is smaller than the intermediate voltage $(\frac{1}{2}).V_{cc}$.

For example, when the size of transistor Q10 of second intermediate voltage output stage 10b is set ten times as large as that of transistor Q9 of first intermediate voltage output stage 10a, the current id flowing into transistor Q10 of second intermediate voltage output stage 10b is ten times as large as the current ic flowing into transistor Q6 of first intermediate voltage output stage 10a. Therefore, compared to the conventional intermediate voltage generating circuit in which transistors Q9 and Q10 configuring a current mirror are not provided, the output impedance of the intermediate voltage generating circuit of the present invention is one eleventh as large as that of the conventional intermediate voltage generating circuit.

As described above, a current mirror is provided in the intermediate voltage generating circuit which is responsive to the current ia or ic flowing in either transistor Q5 or Q6 of first intermediate voltage output stage 10a for supplying the current ib or id which is larger than the current ia or ic to the output node $N_{OUT}$. Therefore, the output impedance of the intermediate voltage generating circuit is low, and even when the output voltage $V_{OUT}$ fluctuates heavily, it is possible to quickly recover the output voltage $V_{OUT}$ to the intermediate voltage $(\frac{1}{2}).V_{cc}$.

In a steady state, all transistors Q5, Q6, Q7, Q8, Q9 and Q10 of first and second intermediate voltage output stages 10a and 10b are slightly turned off, whereby little current flows in intermediate voltage output stages 10a and 10b. Therefore, current is consumed only in the nonsteady state, while current is hardly consumed in the steady state.

Second Embodiment

In the above-described first embodiment, it was described that a through current does not flow in first and second intermediate voltage output stages 10a and 10b when the reference voltage generating circuit is in the steady state. However, in fact, only a little through out current flows. This is because it is difficult to set the voltage of node NO1 exactly at $(\frac{1}{2}).V_{cc}+V_{THN}$, and to set the voltage of node NO4 exactly at $(\frac{1}{2}).V_{cc}-|V_{THP}|$. In other words, it is necessary to make a little through current flow in first and second reference voltage generating circuits 1 and 2 so that the voltages of nodes NO1 and NO4 follow fluctuation of the power supply voltage $V_{cc}$. So the voltage of node NO1 becomes $(\frac{1}{2}).V_{cc}+V_{THN}+\alpha$ by addition of a voltage drop caused by an internal resistance in the conductive state of transistor Q1. Similarly, the voltage of node NO4 becomes $(\frac{1}{2}).V_{cc}-(|V_{THP}|+\alpha)$. Therefore, also in the steady state, since N channel MOS transistor Q5 and P channel MOS transistor Q6 are slightly turned on, only a little through current flows in first intermediate voltage output stage 10a. Since the through current is amplified by second intermediate voltage output stage 10b, there is also a possibility that a large through current flows in the whole intermediate voltage generating circuit.

Figure 3:
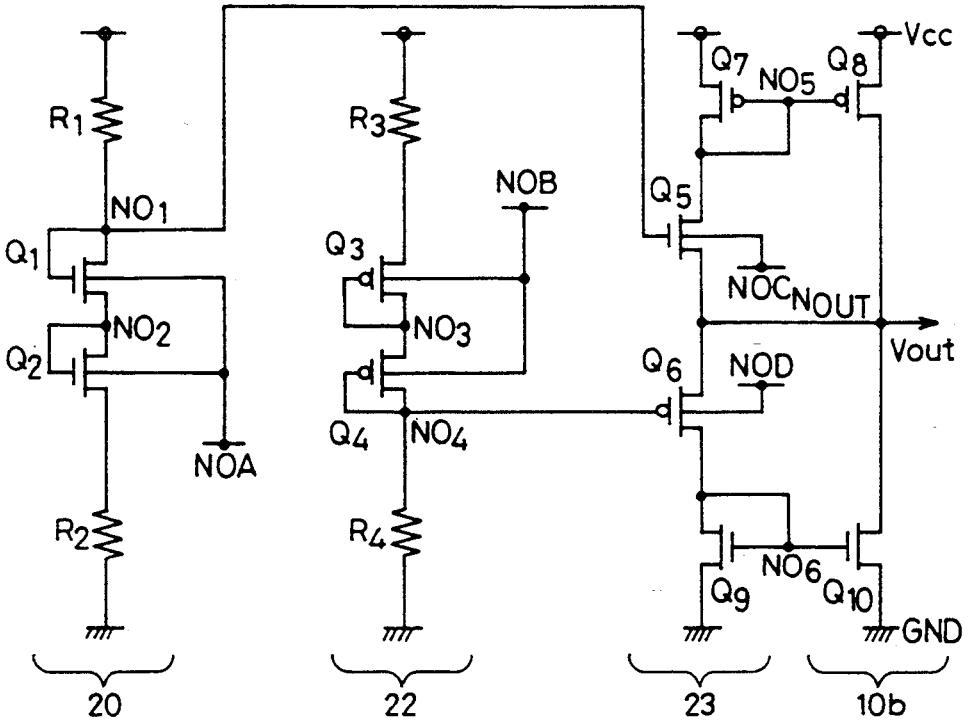
FIGS. 3 to 5 are schematic diagrams showing an intermediate voltage generating circuit of another embodiment in accordance with the present invention.

FIG. 3 is a schematic diagram of an intermediate voltage generating circuit in which such problems are solved. The intermediate voltage generating circuit of FIG. 3 is the second embodiment according to the present invention.

Referring to FIG. 3, the intermediate voltage generating circuit includes a first reference voltage generating circuit 20, a second reference voltage generating circuit 22, a first intermediate voltage output stage 23, and a second intermediate voltage output stage 10b. The second embodiment is different from the first embodiment in that the substrate voltage of N channel MOS transistors Q1 and Q2 of first reference voltage generating circuit 20 and the substrate voltage of the N channel MOS transistor Q5 of first intermediate voltage output stage 23 are structured so that they can be separately controlled. In addition to this, the second embodiment differs from the first embodiment in that the second embodiment is structured so that the substrate voltage of P channel MOS transistors Q3 and Q4 of second reference voltage generating circuit 22 and the substrate voltage of the P channel MOS transistor Q6 of first intermediate voltage output stage 23 can be separately controlled.

In general, the larger the absolute value of the substrate voltage of the MOS transistors, the larger the absolute value of the threshold voltage of the transistors tend to be.

Therefore, when the voltage (<0) of the node NOA connected to the substrate of N channel MOS transistors Q1 and Q2 of first reference voltage generating circuit 20 is set higher than the voltage (<0) of the node NOC connected to the substrate of N channel MOS transistor Q5 of first intermediate voltage output stage 23, the threshold voltage $V_{THNa}$ (>0) of N channel MOS transistors Q1 and Q2 becomes smaller than the threshold voltage $V_{THNc}$ (>0) of N channel MOS transistor Q5.

It should be noted that the state where the substrate voltage of a negative value of N channel MOS transistors Q1 and Q2 is set higher than the substrate voltage of a negative value of N channel MOS transistor Q5 corresponds to the state where the absolute value of the substrate voltage of N channel MOS transistors Q1 and Q2 is set smaller than the absolute value of the substrate voltage of N channel MOS transistor Q5.

When the voltage (>0) of the node NOB connected to the substrate of P channel MOS transistors Q3 and Q4 of second reference voltage generating circuit 22 is set lower than the voltage (>0) of the node NOD connected the substrate of first P channel MOS transistor Q6 of first intermediate voltage output stage 23, the absolute value $|V_{THPb}|$ of the threshold voltage $V_{THPb}$ (<0) of P channel MOS transistors Q3 and Q4 becomes smaller than the absolute value $|V_{THPd}|$ of the threshold voltage $V_{THPd}$ (<0) of P channel MOS transistor Q6.

As a result, the voltage of node NO1 attains $(\frac{1}{2}).V_{cc}+V_{THNa}+\alpha$. Even in the steady state, since the relation $V_{THNa}+\alpha<V_{THNc}$ always holds, N channel MOS transistor Q5 of first intermediate voltage output stage 23 is sufficiently turned off.

On the other hand, the voltage of node NO4 attains $(\frac{1}{2}).V_{cc}-(|V_{THPb}|+\alpha)$. Since the relation $|V_{THPb}|+\alpha<|V_{THPd}|$ always holds, P channel MOS transistor Q6 of first intermediate voltage output stage 23 is also sufficiently turned off.

According to the intermediate voltage generating circuit, no through current flows in first and second intermediate voltage output stages 23 and 10*b* in the steady state where the output voltage $V_{OUT}$ attains the intermediate voltage $(\frac{1}{2}).V_{cc}$.

In the non-steady state in which the output voltage $V_{OUT}$ is shifted from the intermediate voltage $(\frac{1}{2}).V_{cc}$, the intermediate voltage generating circuit has sufficiently low output impedance as in the case of the above-described first embodiment. Therefore, the output voltage $V_{OUT}$ quickly recovers to the intermediate voltage $(\frac{1}{2}).V_{cc}$.

Figure 4:
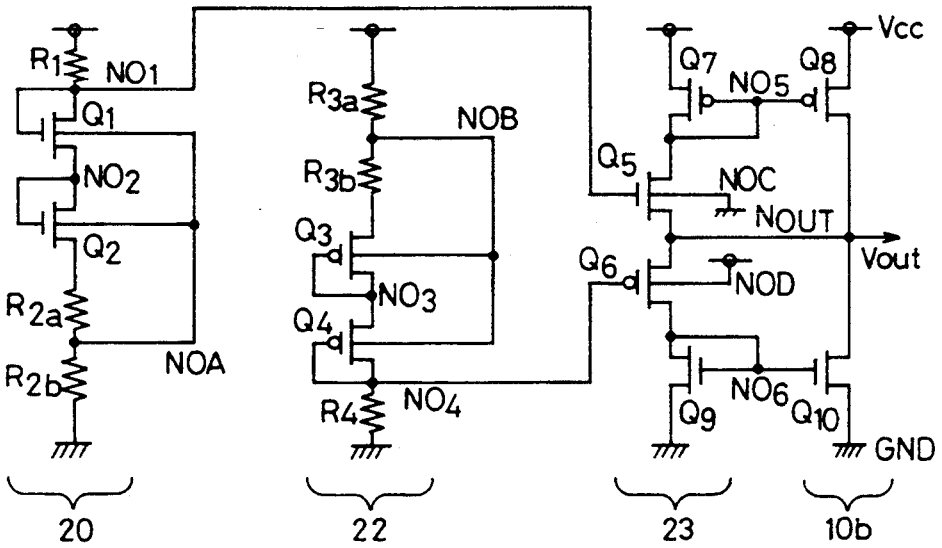

FIG. 4 is a schematic diagram of a circuit showing more specifically a substrate voltage generating circuit of the second embodiment shown in FIG. 3.

It is a little difficult to adjust subtly voltages of the above-described nodes NOA, NOB, NOC and NOD. Therefore, for example, as shown in FIG. 4, the node NOC is connected to the ground, while the node NOA is connected to the intermediate node of two resistors R2*a* and R2*b* configured by division of resistor R2 of first reference voltage generating circuit 20. On the other hand, the node NOD is connected to the power supply voltage $V_{cc}$, while the node NOB is connected to the intermediate node of two resistors R3*a* and R3*b* configured by division of resistor R3 of second reference voltage generating circuit 22.

As a result, the conditions of each of the above-described substrate voltages are implemented, and it is possible to subtly adjust the voltage of nodes NOA or NOB by arbitrarily setting the ratio of resistors R2*a* and R2*b* or the ratio of resistors R3*a* and R3*b*.

Third Embodiment

Figure 5:
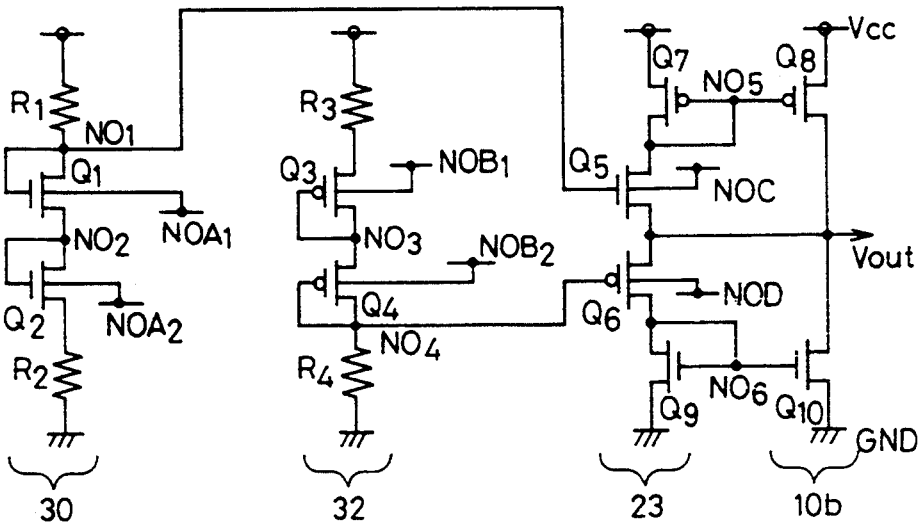
Figure 6:
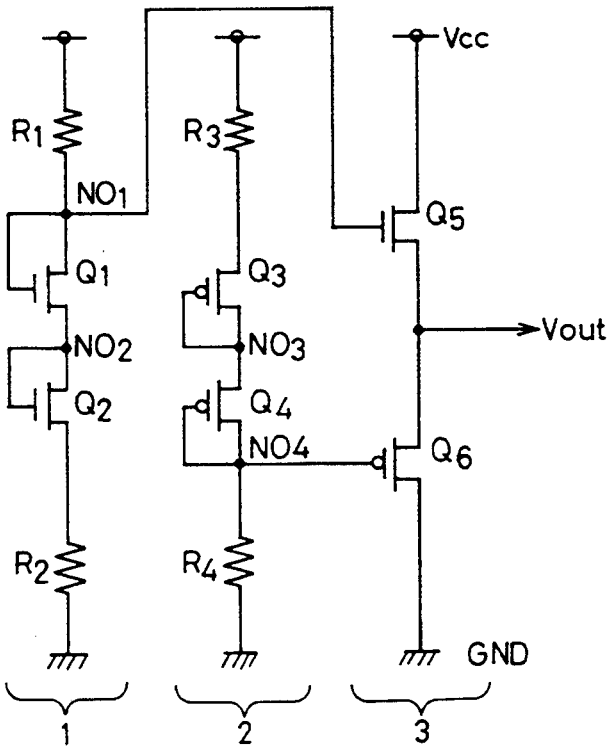
FIG.6 PRIOR ART
FIG. 6 is a schematic diagram showing an example of a conventional intermediate voltage generating circuit.

FIG. 5 is a schematic diagram showing an intermediate voltage generating circuit of a third embodiment according to the present invention. Referring to FIG. 5, the intermediate voltage generating circuit includes a first reference voltage generating circuit 30, a second reference voltage generating circuit 32, a first intermediate voltage output stage 23, and a second intermediate voltage output stage 10*b*. The third embodiment is different from the first and second embodiments in that substrate voltages of two N channel MOS transistors Q1 and Q2 of first reference voltage generating circuit 30 can be independently controlled, and in that the substrate voltages of two P channel MOS transistors Q3 and Q4 of second reference voltage generating circuit 32 can be independently controlled. It should be noted that, in this case, the voltage (<0) of nodes NOA1 and NOA2 serving as the substrate voltage of N channel MOS transistors Q1 and Q2 must be set higher than the voltage (<0) of the node NOC serving as the substrate voltage of N channel MOS transistor Q5 of first intermediate voltage output stage 23. The voltage (>0) of node NOB1 and NOB2 serving as the substrate voltage of two P channel MOS transistors Q3 and Q4 of second reference voltage generating circuit 32 must be set lower than the voltage (>0) of the node NOD serving as the substrate voltage of P channel MOS transistor Q6 of first intermediate voltage output stage 23.

As is clear from the third embodiment, the substrate voltages of N channel MOS transistors Q1 and Q2 of the first reference voltage generating circuit may not necessarily have the same value. It is also true in the case of the substrate voltage of P channel MOS transistors Q3 and Q4 of the second reference voltage generating circuit.

Fourth Embodiment

In general, the absolute value $|V_{TH}|$ of the threshold voltage $V_{TH}$ of an MOS transistor tends to be increased as the channel length L shown in FIG. 2 becomes longer.

Therefore, by making the channel length of N channel MOS transistors Q1 and Q2 of the first reference voltage generating circuit shorter than that of first N channel MOS transistor Q5, as well as by making the channel length of P channel MOS transistors Q3 and Q4 of the second reference voltage generating circuit shorter than that of P channel MOS transistor Q6, it is possible to reduce a through current flowing in first and second intermediate voltage output stages in the steady state, similarly to the case of the second and third embodiments.

Other Embodiment

Although two intermediate voltage output stages are provided in the first to fourth embodiments, three or more intermediate voltage output stages may be provided. In this case, if the size of the transistor of the second intermediate voltage output stage is ten times as large as that of the first intermediate voltage output stage, and if the size of the transistor of the third intermediate voltage output stage is ten times as large as that of the second intermediate voltage output stage, the current flowing in the second intermediate voltage output stage is made ten times as large as that flowing in the first intermediate voltage output stage, and the current flowing in the third intermediate voltage output stage is made ten times as large as that flowing in the second intermediate voltage output stage. Therefore, a current 111 times as large as that flowing in the first intermediate voltage output stage flows in the whole of such an intermediate voltage generating circuit.

By provision of a plurality of current mirror responsive to a current flowing in any transistors of the intermediate voltage output stage for supplying a current of a value at least equal to that current to the output node, it is possible to further reduce output impedance of the intermediate voltage generating circuit.

It should be noted that it is preferred that the substrate voltage or the channel length of the MOS transistor can be adjusted so that a through current doe not flow in the plurality of intermediate voltage output stages in the steady state, similar to the second to fourth embodiments.

In the case where the power supply voltage $V_{cc}$ is negative, the N channel MOS transistor and P channel MOS transistor in the above-described embodiments may be exchanged. In this case, the ground corresponds to the first voltage, and the power supply voltage $V_{cc}$ corresponds to the second voltage. As for first and second reference voltage generating circuits, those shown in FIG. 7, for example, may be used.

Figure 7:
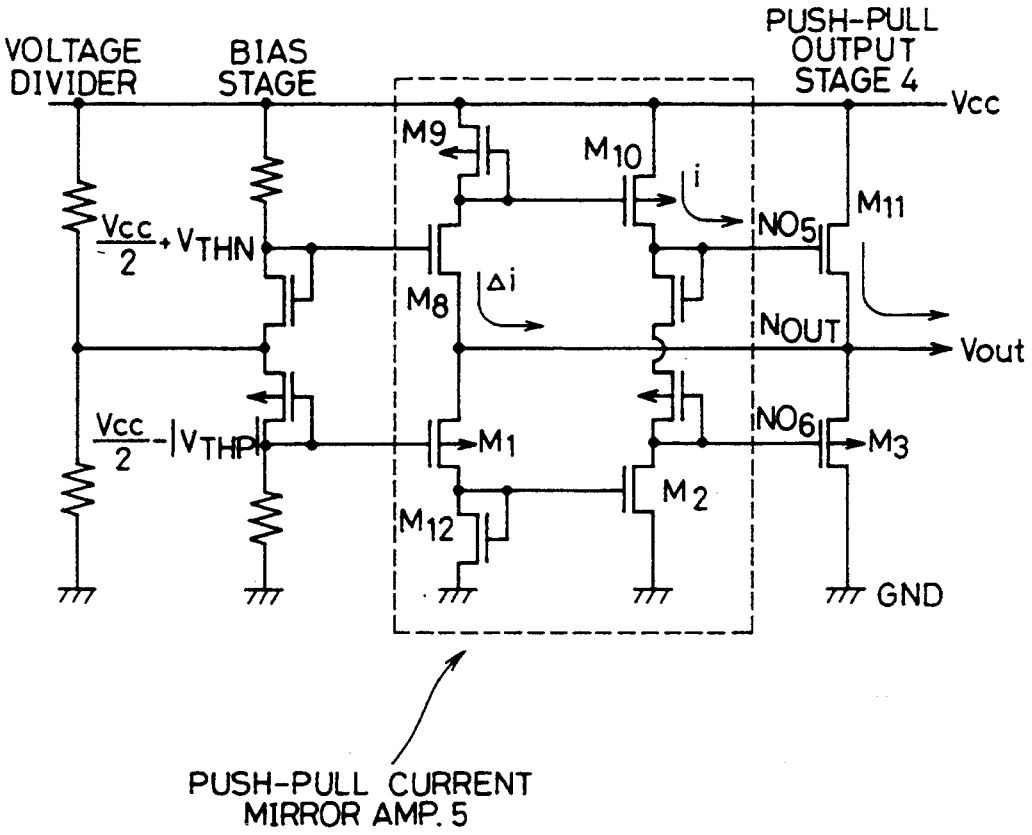
FIG.7 PRIOR ART
FIG. 7 is a schematic diagram showing another example of the conventional intermediate voltage generating circuit.
Figure 8:
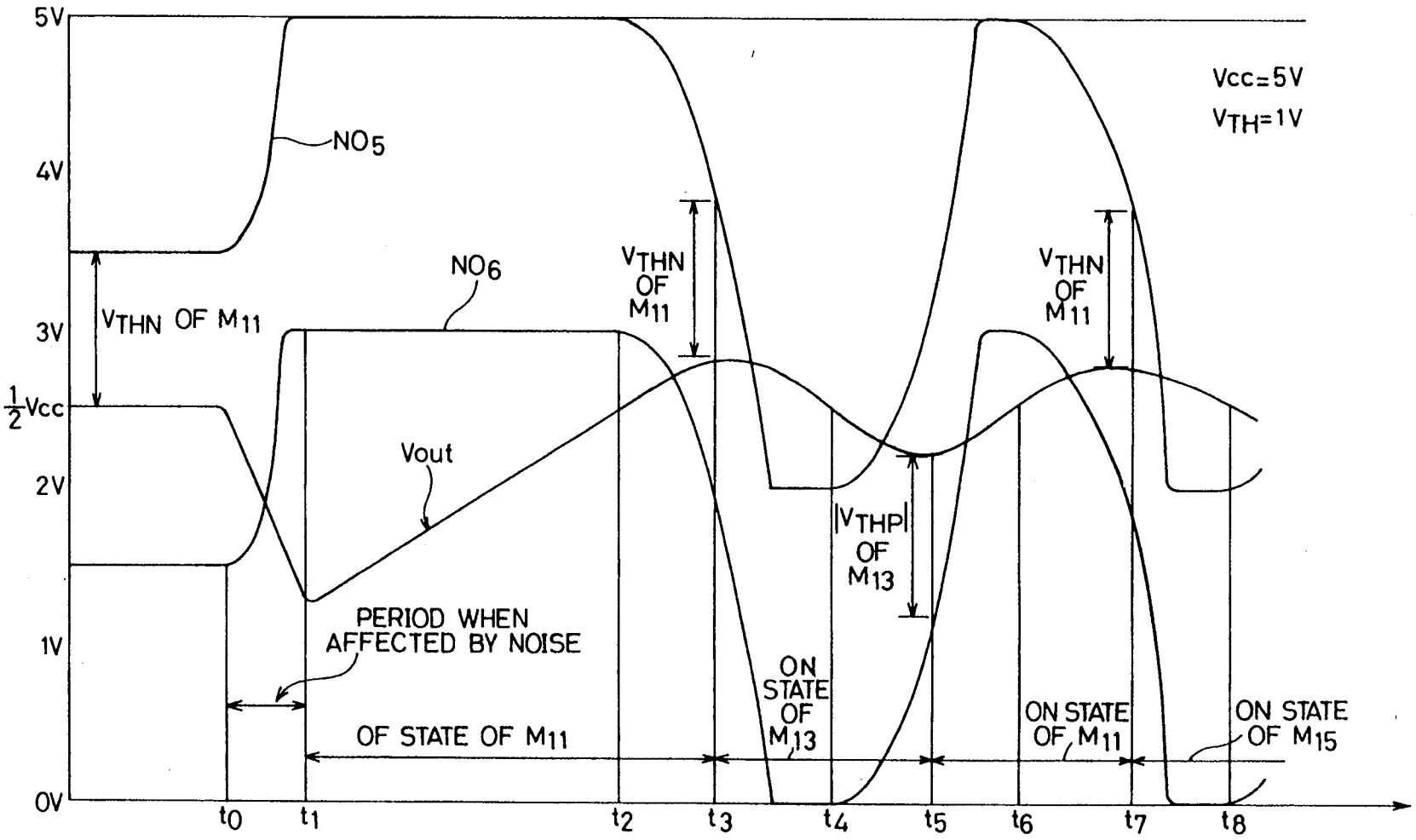
FIG.8 PRIOR ART
FIG. 8 is a graph showing that the voltage of each node changes with the lapse of time for explaining operations of the intermediate voltage generating circuit shown in FIG. 7.

The present invention is different from the intermediate voltage generating circuit shown in FIG. 7 not only in its structure but also in its objects and effects. This is because the intermediate voltage generating circuit shown in FIG. 7 is configured so that sufficient electric charge is supplied to the gate electrode of transistor M11 or M3 configuring push-pull output stage 4 by transistor M10 or M2 configuring push-pull current mirror amplifier 5, whereby a current amplified by push-pull current mirror amplifier 5 does not flow to the output node $N_{OUT}$.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An intermediate voltage generating circuit for generating an intermediate voltage between externally supplied first and second voltages, comprising:

an output node;

intermediate voltage output means including a first N channel MOS transistor and a first P channel MOS transistor connected in series between said first and second voltages, and having sources connected to said output node, respectively;

first reference voltage generating means for generating a first reference voltage shifted from said intermediate voltage by a threshold voltage of said first N channel MOS transistor substantially to provide the first reference voltage to a gate of said first N channel MOS transistor;

second reference voltage generating means for generating a second reference voltage shifted from said intermediate voltage by a threshold voltage of said first P channel MOS transistor substantially to provide the second reference voltage to a gate of said first P channel MOS transistor; and at least one current mirror means responsive to a current flowing in either of said first N channel and P channel MOS transistors for supplying a current having a value equal to or more than a value of the current flowing in either of said first N channel and P channel MOS transistors to said output node.

2. The intermediate voltage generating circuit as recited in claim 1, wherein the threshold voltage of said first N channel MOS transistor is a little larger than said first reference voltage, and an absolute value of the threshold voltage of said first P channel MOS transistor is a little larger than said second reference voltage.

3. The intermediate voltage generating circuit as recited in claim 2, wherein said first reference voltage generating means includes a second N channel MOS transistor connected between said first and second voltages, and having a gate and a drain connected to each other, and a source provided with a voltage the same as said intermediate voltage, said first reference voltage generating means generating said first reference voltage at the gate and the drain of said second N channel MOS transistor, and said second reference voltage generating means includes a second P channel MOS transistor connected between said first and second voltages, and having a gate and a drain connected to each other, and a source provided with a voltage the same as said intermediate voltage, said second reference voltage generating means generating said second reference voltage at the gate and the drain of said second P channel MOS transistor.

4. The intermediate voltage generating circuit as recited in claim 3, wherein an absolute value of a substrate voltage of said first N channel MOS transistor is a little larger than that of a substrate voltage of said second N channel MOS transistor, and an absolute value of a substrate voltage of said first P channel MOS transistor is a little larger than that of a substrate voltage of said second P channel MOS transistor.

5. The intermediate voltage generating circuit as recited in claim 3, wherein channel lengths of said first N channel and P channel MOS transistors are longer than those of said second N channel and P channel MOS transistors.

6. An intermediate voltage generating circuit for generating an intermediate voltage between externally supplied first and second voltages, comprising:

an output node;

first intermediate voltage output means including a first N channel MOS transistor and a first P channel MOS transistor connected in series between said first and second voltages and having sources connected to said output node, a second P channel MOS transistor connected between said first voltage and said first N channel MOS transistor and having a gate and a drain connected to each other, and a second N channel MOS transistor connected between said first P channel MOS transistor and said second voltage and having a gate and a drain connected to each other;

second intermediate voltage output means including a third P channel MOS transistor and a third N channel MOS transistor connected in series between said first and second voltages and having gates connected to the gates and the drains of said second P channel and N channel MOS transistors and drains connected to said output node;

first reference voltage generating means for generating a first reference voltage shifted from said intermediate voltage by a threshold voltage of said first N channel MOS transistor substantially to provide the first reference voltage to a gate of said first N channel MOS transistor; and second reference voltage generating means for generating a second reference voltage shifted from said intermediate voltage by a threshold voltage of said first P channel MOS transistor substantially to provide the second reference voltage to a gate of said first P channel. MOS transistor.

7. The intermediate voltage generating circuit as recited in claim 6, wherein driving abilities of said third P channel and N channel MOS transistors are larger than those of said second P channel and N channel MOS transistors, respectively.

8. The intermediate voltage generating circuit as recited in claim 7, wherein channel widths of said third P channel and N channel MOS transistors are wider than those of said second P channel and N channel MOS transistors, respectively.

* * * * *